United States Patent [19]

Tsuruzawa et al.

[11] 4,073,027

[45] Feb. 14, 1978

[54] CLEANING BRUSH

[75] Inventors: Teruya Tsuruzawa, Suita; Muneyuki Ueda, Nishinomiya, both of Japan

[73] Assignee: Nippon Seal Co., Ltd., Osaka, Japan

[21] Appl. No.: 755,042

[22] Filed: Dec. 28, 1976

[30] Foreign Application Priority Data

Jan. 6, 1976 Japan ..... 51-1206

[51] Int. Cl.$^2$ ..... A46B 9/10

[52] U.S. Cl. ..... 15/172

[58] Field of Search ..... 15/25, 144, 144 B, 172

[56] References Cited

U.S. PATENT DOCUMENTS

| | | | |
|---|---|---|---|
| 3,421,171 | 1/1964 | Tsuruzawa | 15/172 |
| 3,619,846 | 11/1971 | Krusche et al. | 15/172 |

*Primary Examiner*—Daniel Blum

*Attorney, Agent, or Firm*—Armstrong, Nikaido & Marmelstein

[57] ABSTRACT

A hand-operated cleaning brush having means for automatically turning the brush body in a one-touch operation is provided. The cleaning brush comprises a handle, a brush holder having a hollow boss which is rotatably, upwardly and downwardly mounted on a shaft projecting downwardly from the brush holder into the hollow boss, a spring means arranged within the hollow boss to urge the brush body toward the brush holder, an actuating lever mounted on the brush holder and forked at its front end into two arms which cooperate with the boss such that when the actuating lever is operated the boss together with the brush body is pressed down against the force of the spring thereby releasing the boss from its locking position and causing it to rotate 180° and to return to the position wherein the boss with the brush body is urged toward the brush holder to lock the brush body in place.

5 Claims, 8 Drawing Figures

CLEANING BRUSH

This invention relates to a hand-operated cleaning brush and more particularly to a hand-operated cleaning brush provided with a means for automatically turning the brush body by one-touch operation.

A cleaning brush having a handle formed with a holder on which is fixed a brush body provided with a brush surface having numerous short bristles closely implanted thereon and inclined in one and the same direction is known. Because of its outstanding cleaning effect, this type of cleaning brush is an innovation in the conventional concept of brushes for cleaning. Thus, when the brush is moved on and in contact with an article to be cleaned in the direction of the inclination of the bristles, dust, lint or the like is readily swept off the article and caught up among the bristles, and unless subjected to an external force, the dust, lint or the like is retained among the bristles against falling. This new type of brush may well be regarded as an innovation from the view of its surprising cleaning effect in contrast to a conventional brush comprising relatively long and vertical bristles which merely serve to remove dust from one place to another or to brush the dust off an article to be cleaned.

However, this type of cleaning brush has a drawback that since the bristles are inclined in the same direction the directivity of the brush body is fixed and it is inconvenient in actual use. In order to overcome this drawback there has been developed a cleaning brush of the type as explained above but is provided with a pivotal and spring means arranged between the brush body and holder so that the brush body is turnable through 180° by manual operation (U.S. Pat. No. 3,421,171). However, this new type of cleaning brush has another drawback that, in order to turn the brush body through 180°, it is necessary to pull the brush body away from the holder against the spring and then turn the brush body so that the use of both hands (one for grasping the handle and the other for the turning operation) is inevitable.

Therefore it is an object of this invention to provide a cleaning brush of the type described above but is provided with a novel means to enable the brush body automatically turnable by a single hand through a single action.

The other objects of this invention will become apparent from the following description.

Briefly, the cleaning brush according to this invention comprises a handle provided with a brush holder for holding a brush body provided with a brush surface having numerous short bristles inclined in the same direction; a hollow boss provided on the back side of the brush body and within said brush holder and is rotatably, upwardly and downwardly movably mounted on a projection shaft extending downwardly from the brush holder into said hollow boss; a spring means arranged within said hollow boss to urge the boss with the brush body toward the brush holder so that the brush body is held on the brush holder for enabling brushing operation; the hollow boss comprising an upper portion and a lower portion which is larger in diameter than the upper portion; said lower boss portion being formed in its periphery with vertical grooves extending axially thereof in diametrically opposed relation to each other; projecting members extending downwardly from the brush holder and engageable with said grooves respectively so as to lock the boss against rotation when the projecting members are in engagement with the respective grooves; said lower boss portion being divided by said grooves into one-half circumferential sections each having a downwardly slanting top surface inclined circumferentially in the same direction; an actuating lever mounted on said holder and forked at its front end into two arms which extend above the upper boss portion; raised portions provided on the top surface of the upper boss portion or on said arms; inclined surfaces provided on said arms or on the top surface of the upper boss portion and cooperating with said raised portions; the arrangement being such that when the actuating lever is operated the boss together with the brush body is pressed down against the force of the spring and the projecting members are disengaged from the grooves to release the boss from locking whereupon the boss is somewhat rotated to allow the projecting members ride on the slanting top surfaces on the lower boss portion so that when the actuating lever is released the projecting members slide down along the slanting top surfaces with a result that the boss together with the brush body is rotated to complete 180° rotation and returned to the original position.

In one embodiment of this invention the raised portions are provided on the top face of the upper boss portion, while the inclined surfaces which cooperate with said raised portions are provided on the arms of the actuating lever.

In another embodiment of this invention the raised portions are provided on the arms of the actuating lever, while the inclined surfaces which cooperate with said raised portions are provided on the top face of the upper boss portion.

In any case, the manner of the cooperation is such that when the actuating lever is operated the boss (together with the brush body) is pushed down (against the force of the spring) due to engagement between the raised portions and corresponding inclined surfaces. During this push down or press down stage the boss is restrained against rotation due to the engagement of the projecting members with the respective vertical grooves formed in the lower boss portion. Upon continuing this press-down the projecting members will finally be disengaged from the vertical grooves so that the boss is released from the restraint, whereupon due to the cooperation with the raised portions and inclined surfaces and due to the action of the spring boss is somewhat rotated to allow the lower ends of the projecting members ride on the higher end portions of the respective downwardly slanting surfaces provided on the top face of the lower boss portion.

When the actuating lever is released in this stage, the press-down force no longer is in effect but only the force of the spring will act. Therefore, due to this force of spring, the lower ends of the projecting members are allowed to slide down the respective slanting surfaces from the higher end portions to the lower end portions with a result that the boss together with the brush body will rotate through 180° while the boss together with the brush body is moved upwardly to the original position. Upon passing through the lower end portions of the slanting surfaces the projecting members again drop into the vertical grooves for engagement and the brush body is again held on the holder for enabling brushing operation.

The invention will be further explained by referring to the accompanying drawings wherein.

Figure 1:
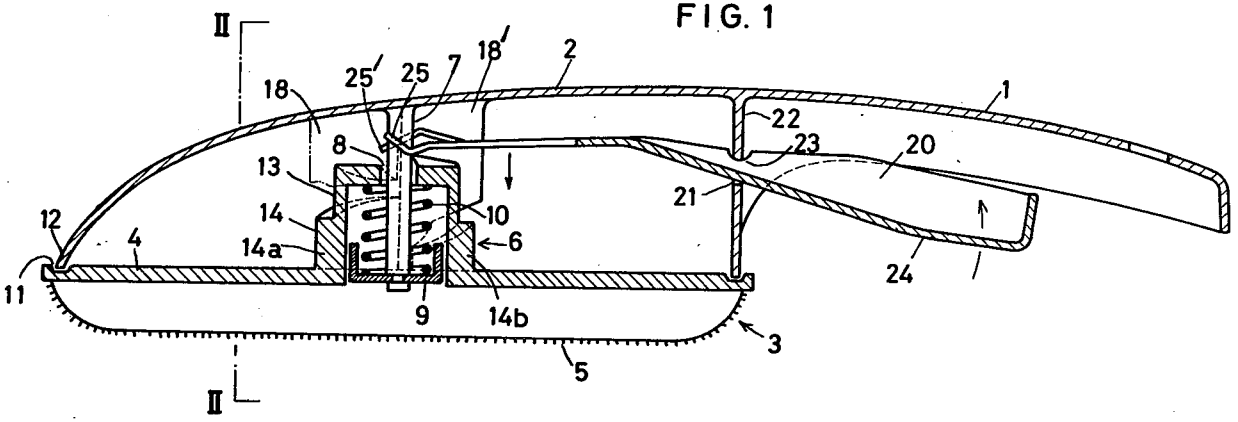
FIG. 1 is a longitudinal cross-section of a cleaning brush embodying the present invention.
Figure 2:
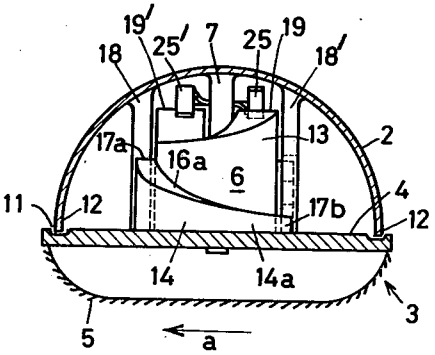
FIG. 2 is vertical cross-section taken along the line II—II of FIG. 1.
Figure 4:
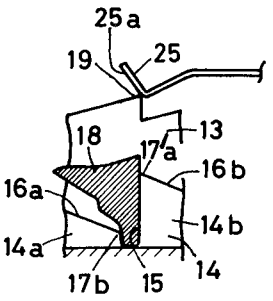
FIGS. 4, 5 and 6 are illustrative views for explaining the operation.

Referring to FIGS. 1 - 6 which show a first embodiment of this invention, the cleaning brush comprises a handle 1 formed with a hollow brush holder 2. Indicated with the numeral 3 is a brush body which comprises a support plate 4 for supporting a brush surface 5 having numerous short bristles inclined in the same direction (the direction of the arrow *a* in FIG. 2). A hollow boss 6 is provided on the back side of the support plate 4 to project upwardly within said holder 2. The boss 6 is mounted on a projection shaft 7 which extends downwardly from the upper wall of the holder 2 into the boss 6 through the upper opening 8. The boss 6 together with the support plate 4 is rotatable and upwardly and downwardly movable in the manner to be explained hereinafter.

At the lower end of the projection shaft 7 there is provided a seat 9. Within the hollow boss 6 and around the projection shaft 7 there is arranged a spring 10 which acts between the top wall of the boss 6 and the seat 9. By means of this spring 10 the brush body 3 is normally urged toward the holder 2 so that the brush body 3 is held on the brush holder 2 for enabling brushing operation. In this case it is preferable to provide a circumferential groove 11 or ridge on the support plate 4 so that the lower edge 12 of the holder 2 engages therewith, whereby the brush body 3 is stably held on the holder 2.

The hollow boss 6 comprises an upper portion 13 and a lower portion 14 which is larger in diameter than the upper portion. The lower boss portion 14 is formed in its periphery with vertical grooves 15,15' diametrically opposed to each other. Said lower boss portion 14 is divided by said grooves 15,15' into one-half circumferential portions 14*a*, 14*b* each having a downwardly slanting top surface 16*a*, 16*b* inclined circumferentially in the same direction. Thus the top surface 16*a* on the lower boss section 14*a* is inclined from the higher end 17*a* to lower end 17*b*, while the top surface 16*b* on the lower boss section 14*b* is inclined from the higher end 17'*a* to lower end 17'*b*. The vertical groove 15 is formed between the higher end 17'*a* and lower end 17*b*, while the vertical groove 15' is formed between the lower end 17'*b* and higher end 17*a*.

Projecting members 18,18' extend downwardly from the inside wall of the brush holder 2 and are slidably engageable with the vertical grooves 15,15' respectively so as to lock the boss 6 against rotation when the projecting members 18, 18' are in engagement with the corresponding vertical grooves 15,15' respectively.

The upper boss portion 13 is provided at its top with diametrically opposed raised portions 19,19'. In the embodiment shown in FIGS. 1 - 6 each raised portion 19 or 19' takes a form of an inclined portion which is preferable but not essential. The raised portions 19,19' are diametrically opposed and their highest portions are positioned to correspond with the respective grooves 15,15'.

An actuating lever 20 is mounted on the holder 2. More particularly the actuating lever 20 extends into the hollow holder 2 through an opening 21 formed in a rear wall 22 of the holder 2. The lever 20 has a cutout portion 23 which bears against the upper edge of the opening 21 to serve as a fulcrum. The rear portion of the lever 20 constitutes a manipulating portion 24 which extends along the handle 1 but is exposed below the handle for enabling operation by hand.

Figure 3:
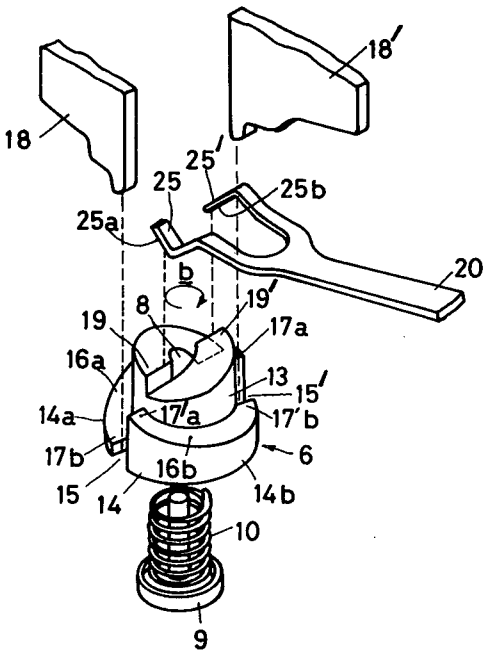
FIG. 3 is an exploded perspective view of the principal parts shown in FIG. 1.

The actuating lever 20 is forked at its front end into two arms 25,25' which extend above the upper boss portion 13 and contact with the raised portions 19,19' respectively. As shown the arm 25 is bent upwardly, while the other arm 25' is bent downwardly to form inclined inner surfaces 25*a*, 25*b* engageable with the raised portions 19,19' respectively. The arms 25,25' and raised portions 19,19' are relatively so positioned that normally (or when the projecting members 18,18' are in engagement with the respective grooves 15,15') the upwardly inclined surface 25*a* is in contact near its root portion with the corresponding raised portion 19 (FIGS. 3 - 6) while the downwardly inclined surface 25*b* is in contact near its top portion with the corresponding raised portions 19' (FIG. 3).

The operation of this brush shown in FIGS. 1 - 6 is as follows. In the normal state shown in FIGS. 1 and 2, the projecting members 18,18' are in full engagement with the respective vertical grooves 15,15' and the brush body 3 is held on the brush holder 2 so that the brush is in the state of brushing operation while grasping the handle 1 for example by the right hand.

Figure 5:
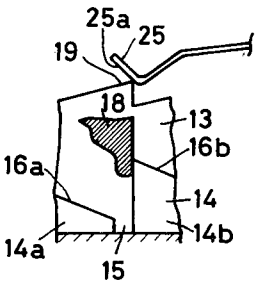
Figure 6:
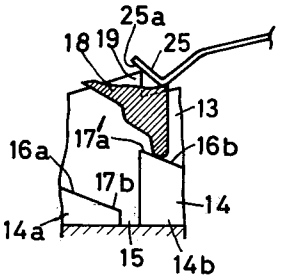

When it is desired to turn the brush body 3, the manipulating portion 24 of the actuating lever 20 is pushed upwardly by a finger of the same hand grasping the handle 1, whereupon the forward portion of the lever 20 is pushed down with the cutout portion 23 as the fulcrum. Thus the arms 25,25' press the corresponding raised portions 19,19' on the upper boss portion 13 (and hence together with the lower boss portion 14 and brush body 3) downwardly against the force of the spring 10. When the arms 25,25' are pressed downwardly in contact with the respective raised portions 19,19', the raised portions 19,19' will tend to slide on the corresponding inclined surfaces 25*a*, 25*b* upwardly due to the action of the spring 10. However, such movement is prevented because the boss 6 is locked against rotation due to the engagement of the projecting members 18,18' with the respective vertical grooves 15,15'. Upon continuing this press-down operation, the brush body 3 will be disengaged downwardly from the lower edge 12 of the holder 2. Upon further continuing the press-down operation, the projecting members 18,18' are disengaged from the vertical grooves 15,15' (FIG. 5 to FIG. 6). Upon complete disengagement of the projecting member 18,18' from the grooves 15,15' (FIG. 6) the boss 6 is released from the restraint so that the raised portions 19,19' on the upper boss portion 13 will slide upwardly along the corresponding inclined surfaces 25*a*, 25*b* on the respective arms 25,25' due to the action of the spring 10, whereupon the boss 6 is somewhat rotated in the direction of arrow *b* (FIG. 3), permitting the lower ends of the projecting members 18,18' ride on the respective higher end portions 17'*a*, 17*a* of the slanting top surfaces 16*b*, 16*a* on the lower boss portion 14.

When the actuating lever 20 in its state is relased from the finger, the boss 6, now freed from the depressing force, is forced upwardly by the spring 10. Thus the lower ends of the projecting members 18,18' would slide down along the slanting surfaces **16*b*, 16*a* from the higher end portions 17'*a*, 17*a* to the lower end portions 17'*b*, 17*b* causing to complete 180° rotation of the boss 6 (together with the brush body 3**) in the direction of the arrow *b* (FIG. 3) while bringing the brush body 3 toward the holder 2. Subsequently the lower ends of the projecting members 18,18' pass through the respective lower end portions **17'*b*, 17*b* and drop into the adjacent vertical grooves 15', 15 respectively for engagement again and at the same time the brush body 3 is again held on the holder 2 for enabling brushing operation. Meanwhile the upper boss portion 13 is also rotated through 180° while the arms 25,25' are returned to the original position (FIG. 4) so that the raised portions 19,19' again come into contact with the next or adjacent inclined surfaces 25*b*, 25*a*** in the manner mentioned before, whereupon they are ready for the next turning operation.

By pushing again the manipulating portion 24 of the actuating lever 20 upwardly, the brush body 3 can again be turned through another 180° in the same manner as explained above.

In the embodiment shown in FIGS. 1 - 6 and explained just above, the raised portions are provided on the upper boss portion 13, while the inclined surfaces cooperating therewith for the initial rotation of the boss 6 are formed on the arms 25,25' at the forward end of the actuating lever 20. However, it is also possible that the raised portions are provided on the arms 25,25', while the inclined surfaces cooperating therewith on the upper boss portion 13, as shown in FIGS. 7 and 8.

Figure 7:
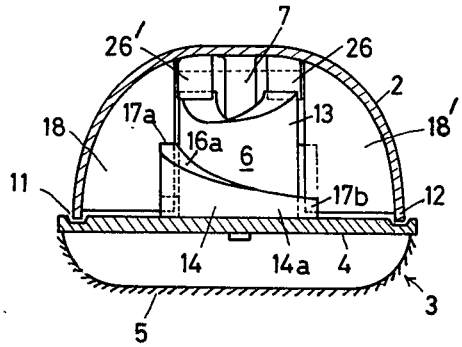
FIG. 7 is a view similar to that of FIG. 2 but showing another embodiment of this invention.
Figure 8:
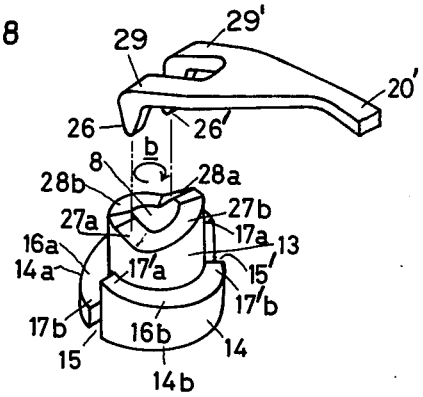
FIG. 8 is an exploded perspective view of the principal parts shown in FIG. 7.

Thus, the embodiment shown in FIGS. 7 and 8 is same as that shown in FIGS. 1 - 6 except that there are provided downwardly directed raised portions 26,26' at the forward ends of the respective arms 29,29' and that there are provided inclined surfaces **27*a*, 27*b*, 28*a*, 28*b* on the top of the upper boss portion 13. More particularly, on the top of the upper boss portion 13 there are provided downwardly inclined surface 27*a* followed by upwardly inclined surface 27*b*, and also downwardly inclined surface 28*a* followed by upwardly inclined surface 28*b*. These surfaces 27*a* -27*b* and 28*a* -28*b* are diametrically opposed as shown in FIG. 8. Normally the raised portion 26 is in contact with the upper portion of the downwardly inclined surface 27*a*, while the raised portion 26' is in contact with the upper portion of the downwardly inclined surface 28*a***.

When it is desired to turn the brush body 3, the manipulating portion 24 of the actuating lever 20' is pushed upwardly so that the boss 6 (together with the brush body 3) is pressed down against the force of the spring 10. In this case the raised portions 26,26' will tend to slide downwardly along the respective downwardly inclined surfaces **27*a*,28*a* to rotate the boss 6** to the direction of the arrow *b* (FIG. 8) due to the force of the spring 10, but such movement is prevented because the boss 6 is locked against rotation due to the engagement of the projecting members 18,18' with the respective vertical grooves 15,15'. Upon continuing the press-down operation the brush body 3 is disengaged downwardly from the lower edge 12 of the holder 2 and then the projecting members 18,18' are disengaged from the grooves 15,15' as explained before in connection with the embodiment of FIGS. 1 - 6. Upon complete disengagement of the projecting members 18,18' from the grooves 15,15' the boss 6 is released from the restraint so that the raised portions 26,26' on the arms 29,29' will slide downwardly along the downwardly inclined surfaces **27*a*,28*a* respectively due to the force of the spring 10, whereupon the boss 6** is rotated in the direction of arrow *b* (FIG. 8), permitting the lower ends of the projecting members 18,18' to ride on the respective higher end portions **17'*a*,17*a* of the inclined surfaces 16*b*,16*a* on the lower boss portion 14 in the same manner as explained in connection with the embodiment of FIGS. 1 - 6**.

When the actuating lever 20' in its state is released from the finger, the boss 6 together with the brush body 3 is rotated through 180° and returned to the original position in the same manner as explained in connection with the embodiment of FIGS. 1 - 6. During this rotation movement the raised portions 26,26' slide upwardly along the upwardly inclined surfaces **27*b*,28*b* respectively and then again come into contact with the upper portions of the next or adjacent downwardly inclined surfaces 28*a*,27*a***, whereupon they are ready for the next turning operation.

What we claim is:

1. A cleaning brush which comprises a handle provided with a brush holder holding a brush body provided with a brush surface having numerous short bristles inclined in the same direction; a hollow boss provided on the back side of the brush body and within said brush holder and is rotatably, upwardly and downwardly movably mounted on a projection shaft extending downwardly from the brush holder into said hollow boss; a spring means arranged within said hollow boss to urge the boss with the brush body toward the brush holder so that the brush body is held on the brush holder for enabling brushing operation; the hollow boss comprising an upper portion and a lower portion which is larger in diameter than the upper portion; said lower boss portion being formed in its periphery with vertical grooves extending axially thereof in diametrically opposed relation to each other; projecting members extending downwardly from the brush holder and engageable with said grooves respectively so as to lock the boss against rotation when the projecting members are in engagement with the respective grooves; said lower boss portion being divided by said grooves into one-half circumferential sections each having a downwardly slanting top surface inclined circumferentially in the same direction; an actuating lever mounted on said holder and forked at its front end into two arms which extend above the upper boss portion; raised portions provided on the top face of the upper boss portion or on said arms; inclined surfaces provided on said arms or on the top face of the upper boss portion and cooperating with said raised portions; the arrangement being such that when the actuating lever is operated the boss together with the brush body is pressed down against the force of the spring and the projecting members are disengaged from the grooves to release the boss from locking whereupon the boss is somewhat rotated to allow the projecting members to ride on the slanting top surfaces on the lower boss portion so that when the actuating lever is released the projecting members slide down along the slanting top surfaces on the lower boss portion with a result that the boss together with the brush body is rotated to a complete 180° rotation and is moved upwardly to the position in which the boss is locked against rotation returned to the original position.

2. A cleaning brush as claimed in claim 1 wherein the raised portions are provided on the top face of the upper boss portion, while the inclined surfaces which cooperate with said raised portions are provided on the arms of the actuating lever.

3. A cleaning brush as claimed in claim 2 wherein the upper boss portion (13) is provided at its top face with diametrically opposed raised portions (19,19'), one (25) of the arms (25,25') of the actuating lever (20) is bent upwardly while the other (25') is bent downwardly to form inclined surfaces **(25*a*,25*b*) engageable with the raised portions (19,19')** respectively.

4. A cleaning brush as claimed in claim 1 wherein the raised portions are provided on the arms of the actuating lever, while the inclined surfaces which cooperate with said raised portions are provided on the top face of the upper boss portion.

5. A cleaning brush as claimed in claim 4 wherein the arms (29,29') are provided with raised portions (26,26'), and inclined surfaces **(27*a* - 27*b*) and inclined surfaces (28*a* - 28*b*) are provided on the top face of the upper boss portion (13) so that they are diametrically opposed to each other and cooperate with the respective raised portions (26,26')**.

* * * * *